US011434580B2

(12) United States Patent
Hirao et al.

(10) Patent No.: US 11,434,580 B2
(45) Date of Patent: Sep. 6, 2022

(54) PLATING APPARATUS

(71) Applicant: EBARA CORPORATION, Tokyo (JP)

(72) Inventors: Tomonori Hirao, Tokyo (JP); Gaku Yamasaki, Tokyo (JP); Takahiro Abe, Tokyo (JP); Toshio Yokoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 185 days.

(21) Appl. No.: 16/796,782

(22) Filed: Feb. 20, 2020

(65) Prior Publication Data

US 2020/0277709 A1 Sep. 3, 2020

(30) Foreign Application Priority Data

Feb. 28, 2019 (JP) ..... JP2019-036719

(51) Int. Cl.
*C25D 17/00* (2006.01)
*C25D 17/02* (2006.01)
*C25D 17/08* (2006.01)

(52) U.S. Cl.
CPC ..... *C25D 17/004* (2013.01); *C25D 17/02* (2013.01); *C25D 17/08* (2013.01)

(58) Field of Classification Search
None
See application file for complete search history.

(56) References Cited

U.S. PATENT DOCUMENTS

2002/0195352 A1* 12/2002 Mayer ..... C25D 17/12 205/687
2004/0055786 A1* 3/2004 Maguire ..... E21B 43/105 175/50

FOREIGN PATENT DOCUMENTS

JP 2000087295 A * 3/2000 ..... C25D 17/008
JP 2004-277815 A 10/2004

* cited by examiner

*Primary Examiner* — Louis J Rufo
(74) *Attorney, Agent, or Firm* — BakerHostetler

(57) ABSTRACT

To provide a plating apparatus that prevents or reduces a diversion of an electric field. According to one embodiment, a plating apparatus for performing a plating process on a substrate held onto a substrate holder is provided. The plating apparatus includes a plating tank configured to receive the substrate holder holding the substrate, a block member that extends to an inside of the plating tank from a wall surface of the inside of the plating tank, and is movable inside the plating tank, and a moving mechanism configured to move the block member toward the substrate holder disposed inside the plating tank.

11 Claims, 15 Drawing Sheets

PLATING APPARATUS

CROSS-REFERENCE TO RELATED APPLICATION

This application is based upon and claims the benefit of priority of the prior Japanese Patent Application No. 2019-36719, filed on Feb. 28, 2019, the entire content of which is incorporated herein by reference.

TECHNICAL FIELD

The present invention relates to a plating apparatus.

BACKGROUND ART

A metal plating film of Cu and the like has been formed on surfaces of a semiconductor device and a substrate for electronic element. For example, in some cases, electroplating is performed with a substrate as a plating object being held by a substrate holder and immersing the substrate together with the substrate holder into a plating tank housing a plating solution. The substrate holder holds the substrate so as to expose a plating surface of the substrate. In the plating solution, an anode is disposed to correspond to the exposed surface of the substrate to apply a voltage between the substrate and the anode, and thus, an electroplating film can be formed on the exposed surface of the substrate.

CITATION LIST

Patent Literature

PTL 1: Japanese Unexamined Patent Application Publication No. 2004-277815

SUMMARY OF INVENTION

Technical Problem

There exists a substrate holder provided with openings on both surfaces on front and back in order to perform plating on both the surfaces of a substrate. For example, there are a substrate holder that holds a substrate so as to expose both a front surface and a back surface of one substrate, and a substrate holder that can hold two substrates to hold the two substrates so as to expose one surface of each of the substrates.

When a plating process is thus performed using a substrate holder provided with the openings on both the surfaces on the front and the back, a large gap sometimes exists between the substrate holder and a plating tank. When there exists the large gap between the substrate holder and the plating tank, a diversion possibly occurs in an electric field heading from the anode to the substrate. For example, a part of the electric field heading from the anode to a front surface of the substrate held onto the substrate holder opposing the anode sometime is diverted around to a back surface of the substrate held onto the substrate holder. When the diversion of electric field occurs, it becomes difficult to form a plating film with a uniform thickness on a substrate. One of the purposes of this disclosure is to provide a plating apparatus that prevents or reduces the diversion of the electric field.

Solution to Problem

According to one embodiment, a plating apparatus for performing a plating process on a substrate held onto a substrate holder is provided. The plating apparatus includes a plating tank configured to receive the substrate holder holding the substrate, a block member that extends to an inside of the plating tank from a wall surface of the inside of the plating tank, and is movable inside the plating tank, and a moving mechanism configured to move the block member toward the substrate holder disposed inside the plating tank.

DESCRIPTION OF EMBODIMENTS

Figure 1:
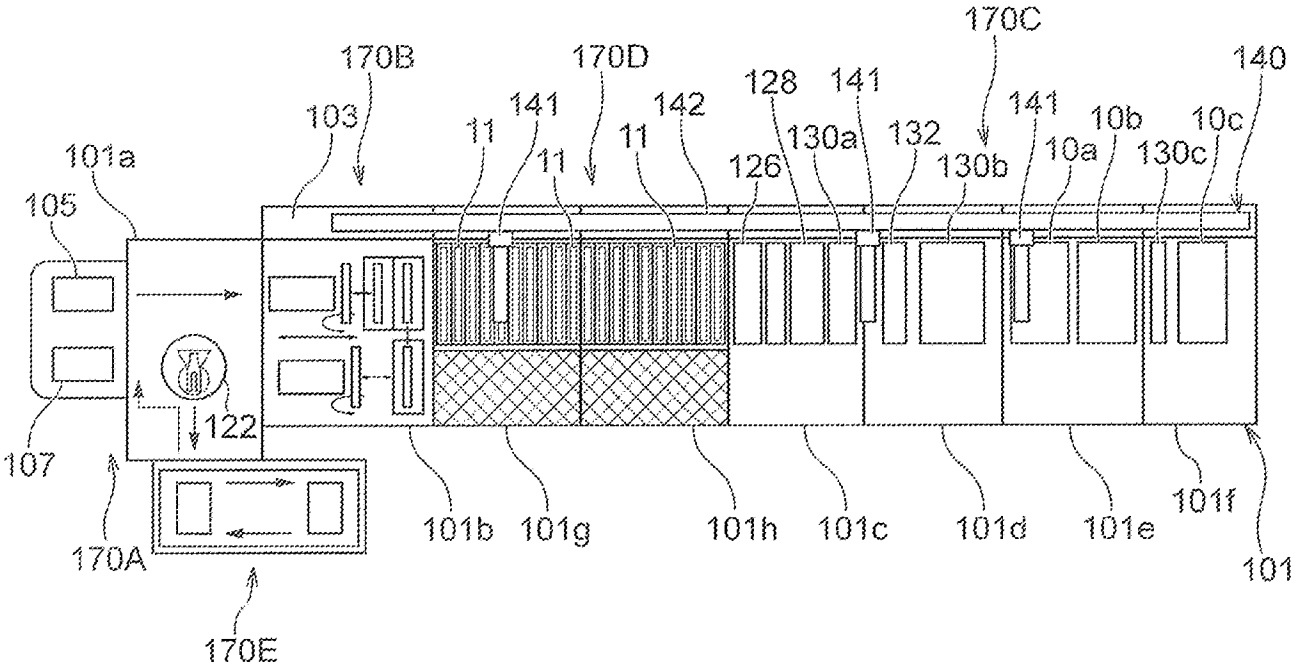
FIG. 1 is a schematic diagram illustrating one embodiment of a plating apparatus.

The following describes embodiments of a plating apparatus according to the present invention with attached drawings. In the attached drawings, identical or similar reference numerals are attached to identical or similar components, and overlapping description regarding the identical or similar components may be omitted in the description of the respective embodiments. Features illustrated in the respective embodiments are applicable to other embodiments in so far as they are consistent with one another. Note that, in the description, a "substrate" includes a magnetic recording medium, a magnetic recording sensor, a mirror, an optical element, a micro mechanical element, or a partially fabricated integrated circuit, not only a semiconductor substrate, a glass substrate, or a printed circuit board.

FIG. 1 is a schematic diagram illustrating one embodiment of a plating apparatus. As illustrated in FIG. 1, the plating apparatus includes a base 101, a controller 103, a loading/unloading station 170A, a substrate setter (mechanical chamber) 170B, a processor (pretreatment chamber, plating chamber) 170C, a holder storage (stocker chamber) 170D, and a cleaner 170E. The controller 103 controls an operation of the plating apparatus. The loading/unloading station 170A loads and unloads a substrate W (see FIG. 2). The substrate setter 170B sets the substrate W onto a substrate holder 11 (see FIG. 2) and removes the substrate W from the substrate holder 11. The processor 170C plates the substrate W. The holder storage 170D stores the substrate holder 11. The cleaner 170E cleans and dries the plated substrate W. The plating apparatus according to the embodiments is an electroplating apparatus that plates both surfaces of a front surface and a back surface of the substrate W with metal by flowing a current in a plating solution. The substrate W as a processing object in the embodiments is, for example, a semiconductor package substrate.

As illustrated in FIG. 1, the base 101 is configured of a plurality of base members 101*a* to 101*h*, and these base members 101*a* to 101*h* are configured to be connectable. The loading/unloading station 170A has components disposed on the first base member 101*a*, the substrate setter 170B has components disposed on the second base member 101*b*, the processor 170C has components disposed on the third base member 101*c* to the sixth base member 101*f*, and the holder storage 170D has components disposed on the seventh base member 101*g* and the eighth base member 101*h*.

The loading/unloading station 170A includes a loading stage 105 on which a cassette (not illustrated) storing the substrate W before plating is mounted, and an unloading stage 107 on which a cassette (not illustrated) receiving the substrate W plated in the processor 170C is mounted. Furthermore, in the loading/unloading station 170A, a transfer device 122 formed of a transfer robot that transfers the substrate W is disposed.

The transfer device 122 is configured to access the cassette mounted on the loading stage 105, extract the substrate W before plating from the cassette, and pass the substrate W to the substrate setter 170B. In the substrate setter 170B, the substrate W before plating is set in the substrate holder 11, and the substrate W after plating is taken out of the substrate holder 11.

The processor 170C includes a pre-wet tank 126, a pre-soak tank 128, a first rinse tank 130*a*, a blow tank 132, a second rinse tank 130*b*, a first plating tank 10*a*, a second plating tank 10*b*, a third rinse tank 130*c*, and a third plating tank 10*c*. These tanks 126, 128, 130*a*, 132, 130*b*, 10*a*, 10*b*, 130*c*, and 10*c* are disposed in this order.

In the pre-wet tank 126, the substrate W is immersed in a pure water as a pretreatment preparation. In the pre-soak tank 128, an oxide film on a surface of a conducting layer, such as a seed layer, formed on the surface of the substrate W is etching-removed by a chemical liquid. In the first rinse tank 130*a*, the substrate W after pre-soaking is cleaned with a cleaning liquid (for example, a pure water).

In at least one plating tank 10 of the first plating tank 10*a*, the second plating tank 10*b*, and the third plating tank 10*c*, both the surfaces of the substrate W are plated. Note that, while in the embodiment illustrated in FIG. 1, there are three plating tanks 10, another embodiment may include any number of plating tanks 10.

In the second rinse tank 130*b*, the substrate W plated in the first plating tank 10*a* or the second plating tank 10*b* is cleaned with a cleaning liquid (for example, a pure water) together with the substrate holder 11. In the third rinse tank 130*c*, the substrate W plated in the third plating tank 10*c* is cleaned with a cleaning liquid (for example, a pure water) together with the substrate holder 11. In the blow tank 132, the liquid is removed from the substrate W after cleaning.

The pre-wet tank 126, the pre-soak tank 128, the rinse tanks 130*a* to 130*c*, and the plating tanks 10*a* to 10*c* are process tanks that can retain process liquids (liquids) inside them. While these process tanks include a plurality of process cells that retain the process liquids, it is not limited to this embodiment, and these process tanks may include a single process cell. At least a part of these process tanks may include the single process cell and the other process tanks may include the plurality of process cells.

The plating apparatus further includes a conveyor 140 that transfers the substrate holder 11. The conveyor 140 is configured to be movable between the components of the plating apparatus. The conveyor 140 includes a fixing base 142 that extends in the horizontal direction from the substrate setter 170B to the processor 170C, and a plurality of transporters 141 configured to be movable along the fixing base 142.

These transporters 141 has respective movable parts (not illustrated) for holding the substrate holder 11 and are configured to hold the substrate holder 11. The transporter 141 is configured to transfer the substrate holder 11 among the substrate setter 170B, the holder storage 170D, and the processor 170C, and furthermore, move the substrate holder 11 up and down together with the substrate W. Exemplary moving mechanisms of the transporter 141 include, for example, a combination of a motor and a rack and pinion. Note that, while in the embodiment illustrated in FIG. 1, three transporters are disposed, another embodiment may employ any number of transporters.

Figure 2:
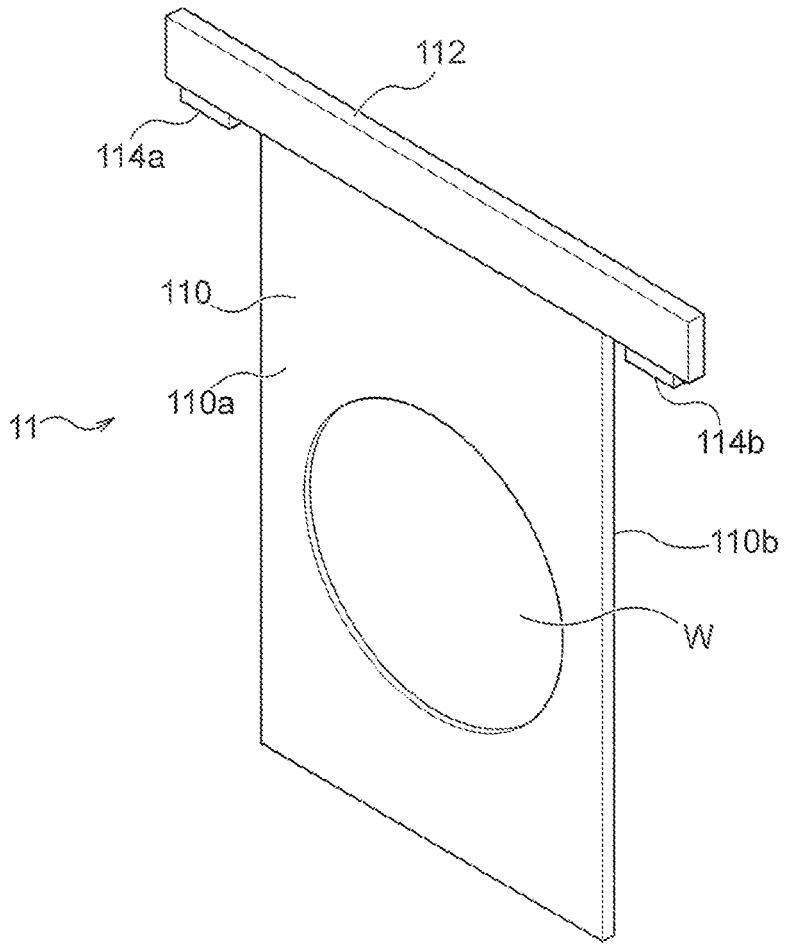
FIG. 2 is a perspective view schematically illustrating an exemplary substrate holder used in the plating apparatus according to one embodiment.
Figure 3A:
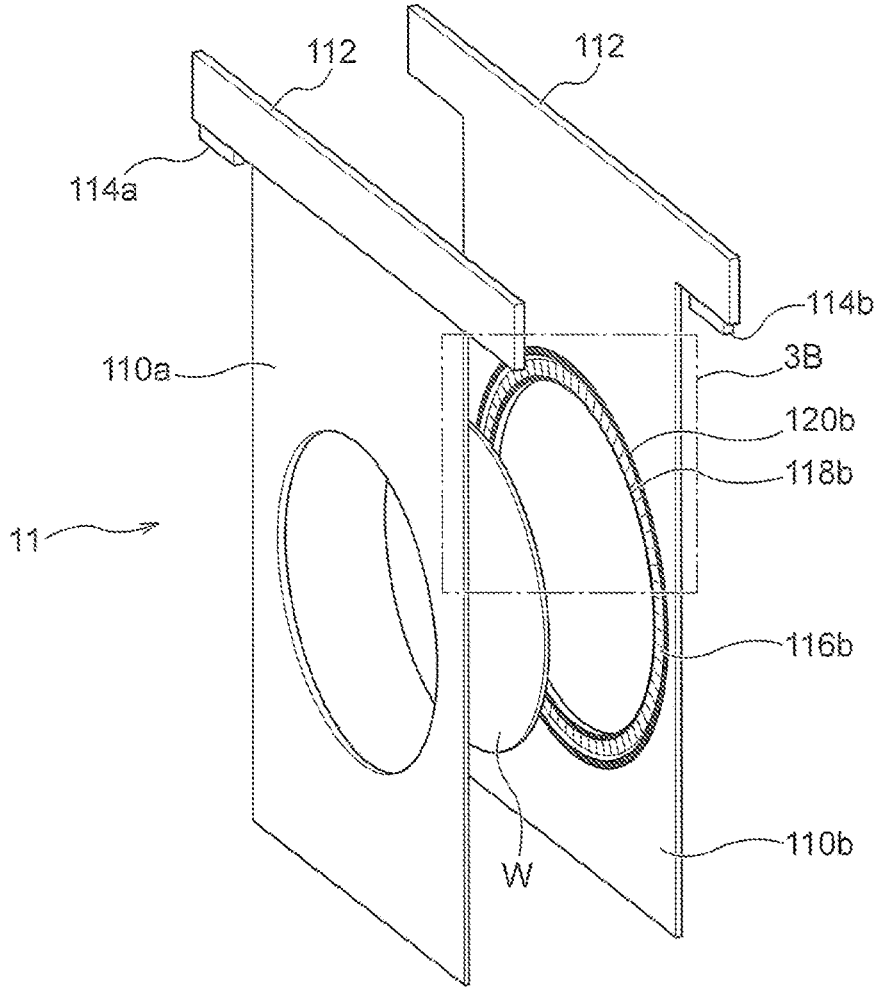
FIG. 3A is a drawing illustrating a state where the substrate holder illustrated in FIG. 2 is separated.
Figure 3B:
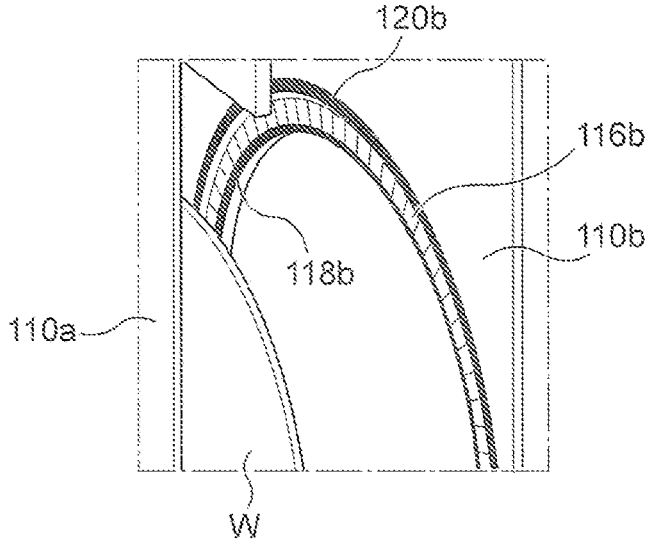
FIG. 3B is a drawing illustrating a part of a region 3B in FIG. 3A enlarged.

A configuration of the substrate holder 11 will be described with reference to FIG. 2 and FIGS. 3A and 3B. FIG. 2 is a perspective view schematically illustrating an exemplary substrate holder used in the plating apparatus according to one embodiment. FIG. 3A is a drawing illustrating a state where the substrate holder illustrated in FIG. 2 is separated. FIG. 3B is a drawing illustrating a part of a region 3B in FIG. 3A enlarged. As illustrated in FIG. 2, the substrate holder 11 includes a main body 110 onto which the substrate W is held and an arm 112 disposed at an upper end of the main body 110. The main body 110 is configured of a first member 110*a* and a second member 110*b*. The substrate holder 11 holds the substrate W with the first member 110*a* and the second member 110*b* sandwiching the substrate W. The first member 110*a* and the second member 110*b* define respective openings, and respective surfaces to be plated on the front surface and the back surface of the substrate W are held so as to be exposed. In other words, the first member 110*a* and the second member 110*b* hold the substrate W by sandwiching only outer peripheral portions of the substrate W from both sides. The substrate holder 11 is transferred with the arm 112 being held by the transporter 141. While the illustrated substrate holder 11 is for holding a circular-shaped substrate W, it is not limited to this, and may be to hold a quadrilateral substrate. In that case, the openings formed on the first member 110*a* and the second member 110*b* are also quadrilateral corresponding to the shape of the substrate W. Alternatively, the substrate W can be a substrate with any shape including a polygonal shape, such as a hexagonal shape. In this case, the openings formed on the first member 110*a* and the second member 110*b* are also in a polygonal shape or the like corresponding to the shape of the substrate W.

As illustrated in FIGS. 3A and 3B, the main body 110 includes electrical contacts 116 configured to be in contact with a peripheral edge portion of the substrate W. The electrical contacts 116 are configured to be in contact with the whole peripheral edge portion of the substrate W. For example, in the case of the substrate holder 11 that holds the circular-shaped substrate W as illustrated, the electrical contacts 116 are in a circular ring shape so as to be in contact with the peripheral edge portion of the circular-shaped substrate W. As another embodiment, in the case of the substrate holder 11 that holds the quadrilateral substrate W, the electrical contacts 116 are in a quadrilateral ring shape so as to be in contact with the peripheral edge portion of the quadrilateral substrate W. Note that, while FIGS. 3A and 3B illustrate an electrical contact 116*b* disposed on the second member 110*b*, an electrical contact 116*a* (opposed to 116*b*) is also similarly disposed on the first member 110*a*.

As illustrated in FIGS. 3A and 3B, inner seal rings 118 (118*a*, 118*b*) are disposed inside the electrical contacts 116 (116*a*, 116*b*) in the main body 110. Outer seal rings 120 (120*a*, 120*b*) are disposed outside the electrical contacts 116. Note that while FIGS. 3A and 3B illustrate that the second member 110*b* includes an inner seal ring 118*b* and the outer seal ring 120*b*, the first member 110*a* includes an inner seal ring 118*a* and an outer seal ring 120*a* similarly.

When the substrate W is held onto the substrate holder 11, the electrical contacts 116 are brought into contact with the peripheral edge portion of the substrate W, and the inner seal rings 118 are brought into contact with the substrate W inside the electrical contacts 116. When the substrate W is held onto the substrate holder 11, an outer seal ring 120 is brought into contact with the substrate W or a structure of the substrate holder 11. Therefore, portions of the electrical contacts 116 of the substrate holder 11 are sealed, and thus, the plating solution does not infiltrate during the plating process.

When the substrate W held onto the substrate holder 11 is immersed in the process liquids inside the respective process tanks, the arm 112 is disposed on arm receiving members (not illustrated) of the respective process tanks. In this embodiment, since the plating tanks 10*a* to 10*c* are electroplating tanks, when power feeding contacts (connector) 114 (114*a*, 114*b*) disposed on the arm 112 are brought into contact with the electrical contacts disposed on the arm receiving member of the plating tank 10, the current is supplied to the front surface and the back surface of the substrate W from an external power supply. In the substrate holder 11 illustrated in FIG. 2, two power feeding contacts 114 are disposed on the arm 112, one power feeding contact 114*a* is for supplying the current to the front surface of the substrate W and the other power feeding contact 114*b* is for supplying the current to the back surface of the substrate W. In the substrate holder 11 according to the illustrated embodiment, the current can be independently supplied to each of the front surface and the back surface of the substrate W. Therefore, currents having different magnitudes can be supplied to the front surface and the back surface of the substrate W. Currents having identical magnitudes may be supplied to the front surface and the back surface of the substrate W.

The plated substrate W is transferred to the substrate setter 170B by the transporter 141 together with the substrate holder 11, and is taken out of the substrate holder 11 in the substrate setter 170B. This substrate W is transferred to the cleaner 170E by the transfer device 122, and cleaned and dried in the cleaner 170E. Afterwards, the substrate W is returned to the cassette mounted on the unloading stage 107 by the transfer device 122.

Figure 4:
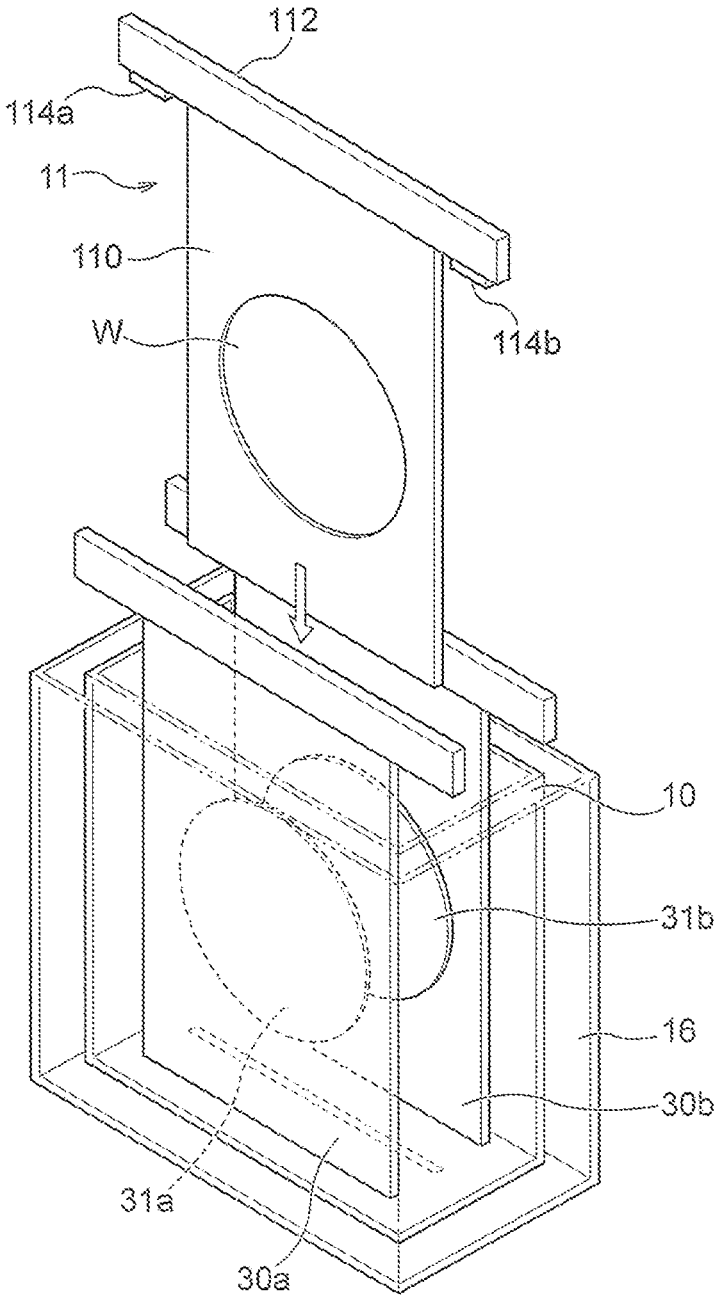
FIG. 4 is a perspective view illustrating a state when the substrate holder onto which a substrate is held is disposed in a plating tank according to one embodiment.

FIG. 4 is a perspective view illustrating a state when the substrate holder 11 that holds the substrate W is disposed in the plating tank 10 according to one embodiment. As illustrated in FIG. 4, two anodes 31*a* and 31*b* are disposed inside the plating tank 10. The anodes 31*a* and 31*b* can be in a shape similar to that of the substrate W as a plating object, and when the substrate W is in a circular shape, the anodes 31*a* and 31*b* can also be in a circular shape, and when the substrate W is in a quadrilateral shape, the anodes 31*a* and 31*b* can also be in a quadrilateral shape. The anodes 31*a* and 31*b* are held by anode holders 30*a* and 30*b*, respectively. The anodes 31*a* and 31*b*, and the anode holders 30*a* and 30*b* can be in any structures, and, for example, can be in any known ones.

As illustrated in FIG. 4, the substrate holder 11 holding the substrate W is disposed between the two anodes 31*a* and 31*b* inside the plating tank 10. When the substrate holder 11 is disposed in the plating tank 10, the front surface of the substrate W faces the direction of the anode 31*a*, and the back surface of the substrate W faces the direction of the anode 31*b*. Note that, while FIG. 4 does not illustrate, in one embodiment, an electric field shielding plate for restricting or adjusting an electric field formed between the substrate W and the anodes 31*a* and 31*b* and a paddle for stirring the plating solution inside the plating tank 10 may be disposed between the substrate holder 11 and the anode holders 30*a* and 30*b*.

In one embodiment, as illustrated in FIG. 4, the plating tank 10 includes an outer tank 16 for receiving the plating solution overflown from the plating tank 10. Note that, in FIG. 4, a part of the plating tank 10, the outer tank 16, and the anode holder 30*a* is illustrated transparent in order to clarify the illustration.

Figure 5A:
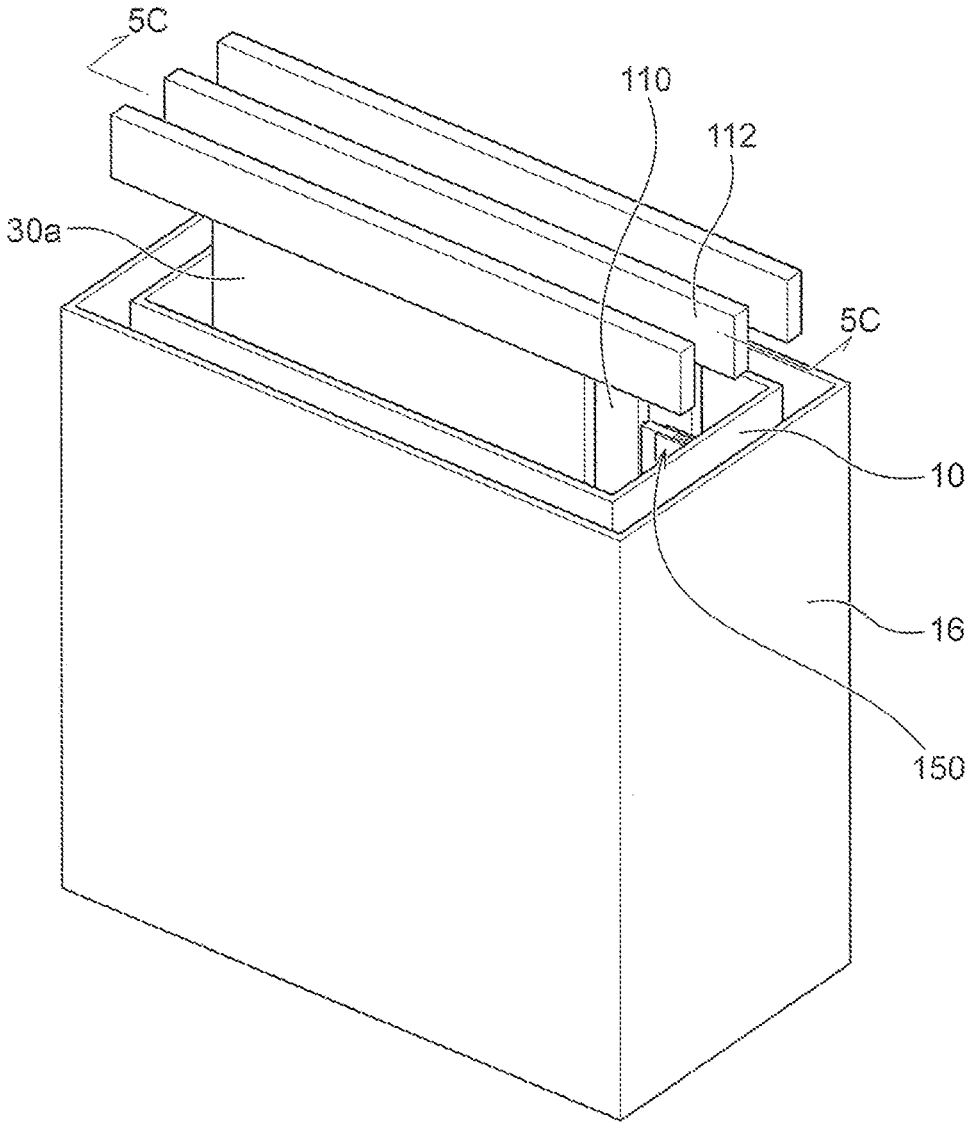
FIG. 5A is a drawing illustrating the plating tank in a state where the substrate holder is disposed according to one embodiment.
Figure 5B:
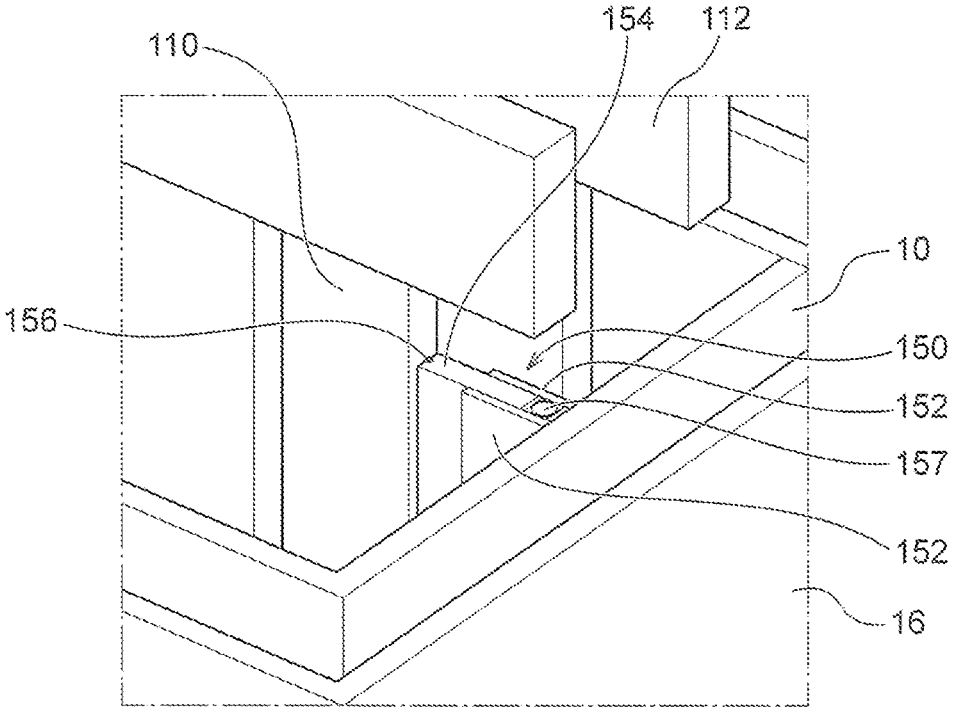
FIG. 5B is a drawing illustrating near a block mechanism illustrated in FIG. 5A enlarged.
Figure 5C:
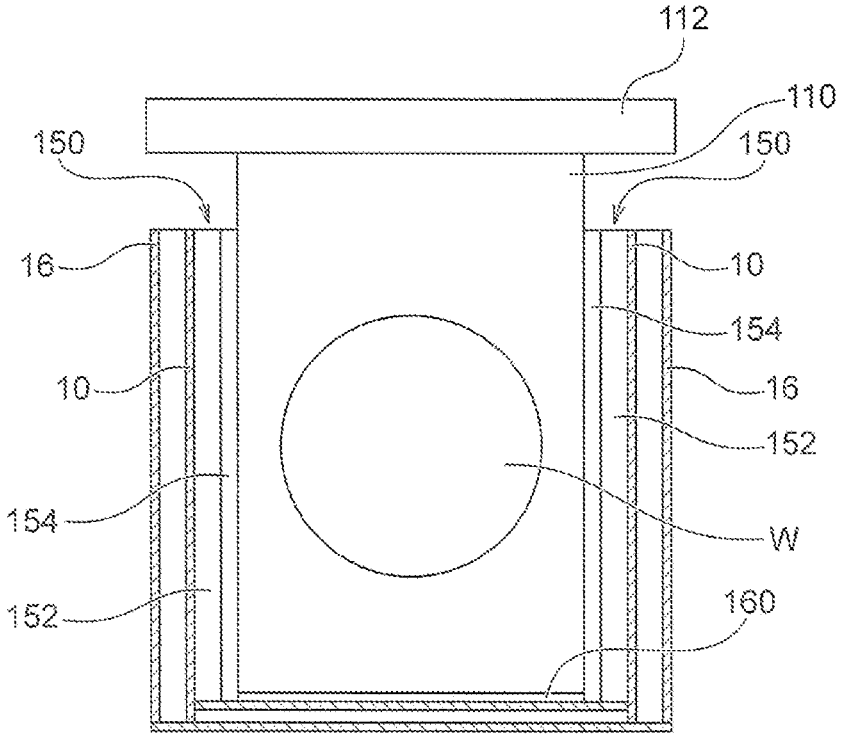
FIG. 5C is a drawing when viewed in the direction indicated by an arrow 5C in FIG. 5A.

FIG. 5A is a drawing illustrating the plating tank 10 in a state where the substrate holder 11 is disposed according to one embodiment. As illustrated in FIG. 5A, the plating tank 10 has an inside side surface on which a block mechanism 150 for preventing a diversion of the electric field inside the plating tank 10 is disposed. FIG. 5B is a drawing illustrating near the block mechanism 150 illustrated in FIG. 5A enlarged. FIG. 5C is a drawing when viewed in the direction indicated by an arrow 5C in FIG. 5A.

As illustrated, the block mechanism 150 includes a guiding member 152 disposed on the inside side surface of the plating tank 10. As illustrated in FIG. 5A and FIG. 5B, the guiding member 152 according to one embodiment can be two opposed plate-shaped members extending from an opened upper end to a lower end where there is a bottom surface of the plating tank 10 on a side surface of the plating tank 10. As illustrated, the block mechanism 150 includes a seal block 154 supported by the guiding members 152. The seal block 154 according to one embodiment can be a plate-shaped member disposed between the guiding members 152 as illustrated. The seal block 154 is configured to be movable toward an inside of the plating tank 10 in a state of being supported by the guiding members 152. When the seal block 154 moves toward the inside of the plating tank 10, the distance between the substrate holder 11 and the seal block 154 decreases.

In one embodiment, as illustrated in FIG. 5B, the seal block 154 has an end at which a fluid spring 157 is disposed. The fluid spring 157 extends over an entire height of the seal block 154 between the two guiding members 152. The fluid spring 157 is connected to a fluid flow passage and a fluid source, which are not illustrated. As soon as a fluid is supplied to the fluid spring 157, the fluid spring 157 expands to move the seal block 154 toward the side surface of the substrate holder 11. As soon as the fluid is discharged from the fluid spring 157, the fluid spring 157 contracts to move the seal block 154 in the direction pulling away from the side surface of the substrate holder 11. For example, in the embodiment illustrated in FIG. 5B, connecting one end of the fluid spring 157 to the end of the seal block 154 ensures moving the seal block 154 as described above by the expansion and the contraction of the fluid spring 157. Note that "the side surface of the substrate holder" is a surface of the substrate holder perpendicular to the surface to be plated of the substrate held onto the substrate holder. In one embodiment, the fluid spring 157 can be a pneumatic spring. In one embodiment, the seal block 154 may be moved by, for example, a cam mechanism instead of the fluid spring 157. Note that the fluid spring 157 is only necessary to be disposed so as to be able to move the seal block 154 as described above, and it is not necessarily required to extend over the entire height of the seal block 154. For example, a plurality of the fluid springs 157 may be disposed in the height direction of the seal block 154 at predetermined intervals.

In one embodiment, as illustrated in FIG. 5B, the seal block 154 includes a seal 156 extending in the height direction on an end surface in the inside direction of the plating tank 10. In one embodiment, the seal 156 can be disposed in a depressed portion formed in the height direction on the end surface in the inside direction of the plating tank 10 of the seal block 154. In the embodiment illustrated in FIGS. 5A to 5B, when the seal block 154 moves in the inside direction of the plating tank 10, the seal 156 is brought into contact with the side surface of the substrate holder 11. Therefore, a gap between the side surface of the substrate holder 11 and the side surface of the plating tank 10 can be eliminated. No gap between the side surface of the substrate holder 11 and the side surface of the plating tank 10 ensures preventing the electric field between one surface of the substrate W and the corresponding anode 31*a* or 31*b* from being diverted around to the opposite side of the substrate W. Note that the seal 156 that contacts the side surface of the substrate holder 11 is not necessarily disposed as one embodiment. As one embodiment, the seal block 154 is not necessarily brought into contact with the side surface of the substrate holder 11. When the distance between the substrate holder 11 and the seal block 154 decreases due to the move of the seal block 154, the diversion of the electric field decreases even without causing the distance between the substrate holder 11 and the seal block 154 to be zero, thereby ensuring forming a uniform plating film. In the embodiment, the seal block 154 is movable, and therefore, the seal block 154 can be retreated when the substrate holder 11 is disposed in the plating tank 10. Therefore, when the substrate holder 11 is disposed in the plating tank 10, the seal block 154 does not interfere with the arrangement of the substrate holder 11. Meanwhile, after disposing the substrate holder 11 in the plating tank 10, the diversion of the electric field can be prevented or reduced by causing the seal block 154 to approach the substrate holder 11.

In one embodiment, the plating tank 10 includes a bottom seal 160 on the bottom surface. The bottom seal 160 is configured such that the bottom surface of the substrate holder 11 is brought into contact with or to be close to the bottom seal 160 in a state where the substrate holder 11 is disposed in the plating tank 10. The bottom seal 160 can be a depressed portion or a projecting portion formed on the bottom surface of the plating tank 10 for one example. In the case where the bottom seal 160 is formed as the depressed portion, the bottom surface of the substrate holder 11 is configured to be fitted to the depressed portion of the bottom seal 160 when the substrate holder 11 is disposed in the plating tank 10. In the case where the bottom seal 160 is formed as the projecting portion, the bottom surface of the substrate holder 11 is configured to be in contact with the projecting portion of the bottom seal 160 when the substrate holder 11 is disposed in the plating tank 10. As one embodiment, the bottom seal 160 and the bottom surface of the substrate holder 11 are not necessarily in contact. Note that, in one embodiment, the bottom seal 160 may be eliminated. When the distance between the substrate disposed in the substrate holder 11 and the bottom surface of the substrate holder 11 is large, an influence of the electric field on the plating process of the substrate on the opposite side caused by the electric field passing through a lower side of the substrate holder 11 to be diverted around to the opposite side of the substrate holder 11 decreases.

Figure 6A:
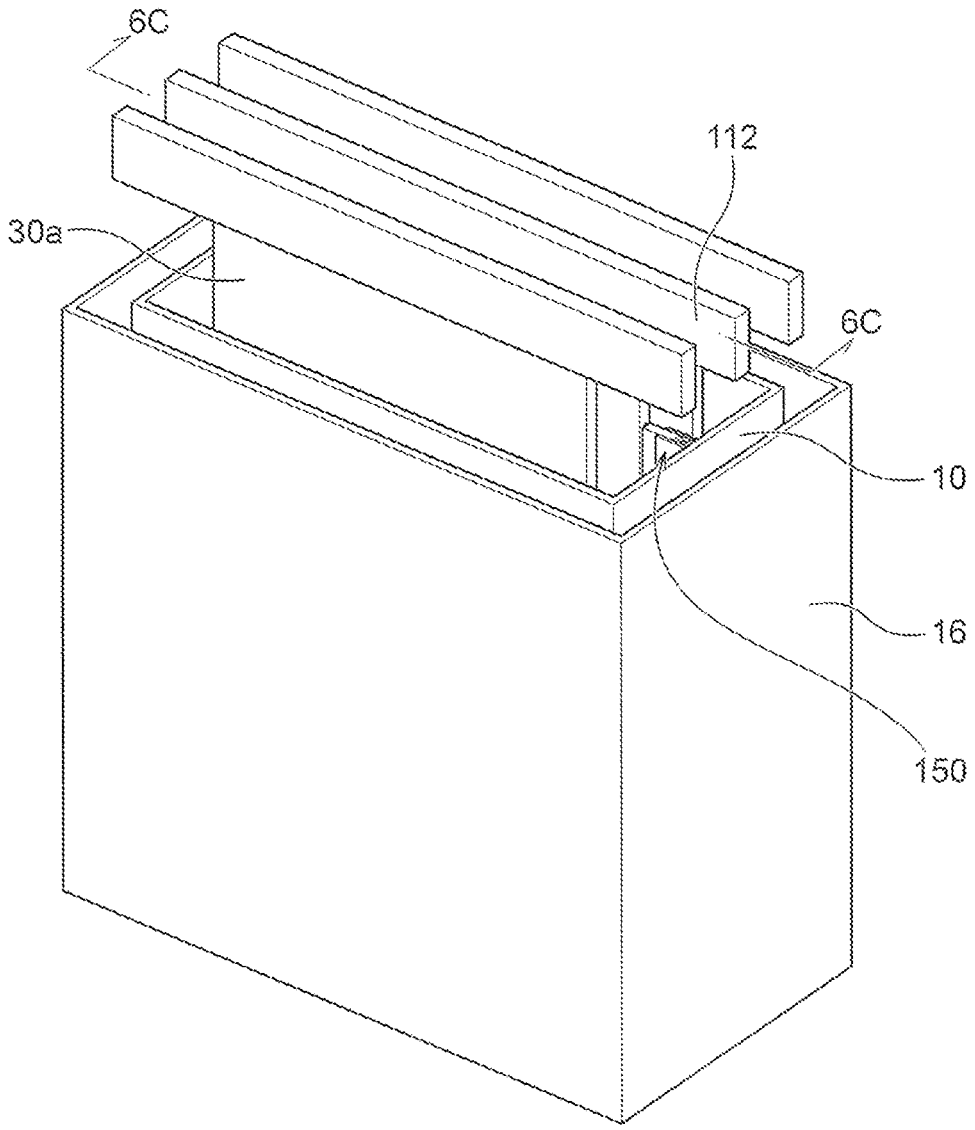
FIG. 6A is a drawing illustrating the plating tank in a state where the substrate holder is disposed according to one embodiment.
Figure 6B:
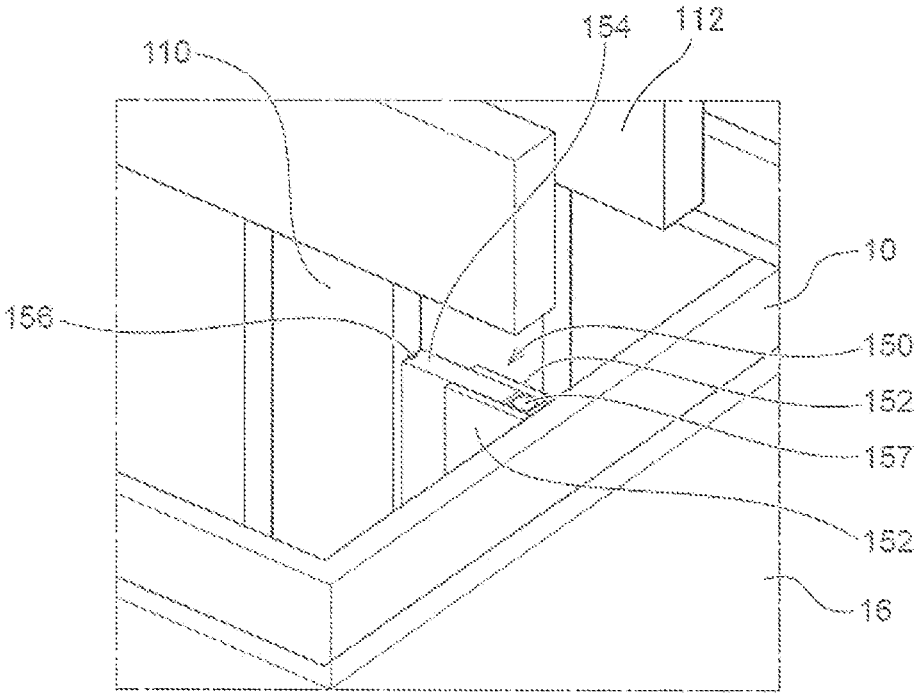
FIG. 6B is a drawing illustrating near a block mechanism illustrated in FIG. 6A enlarged.
Figure 6C:
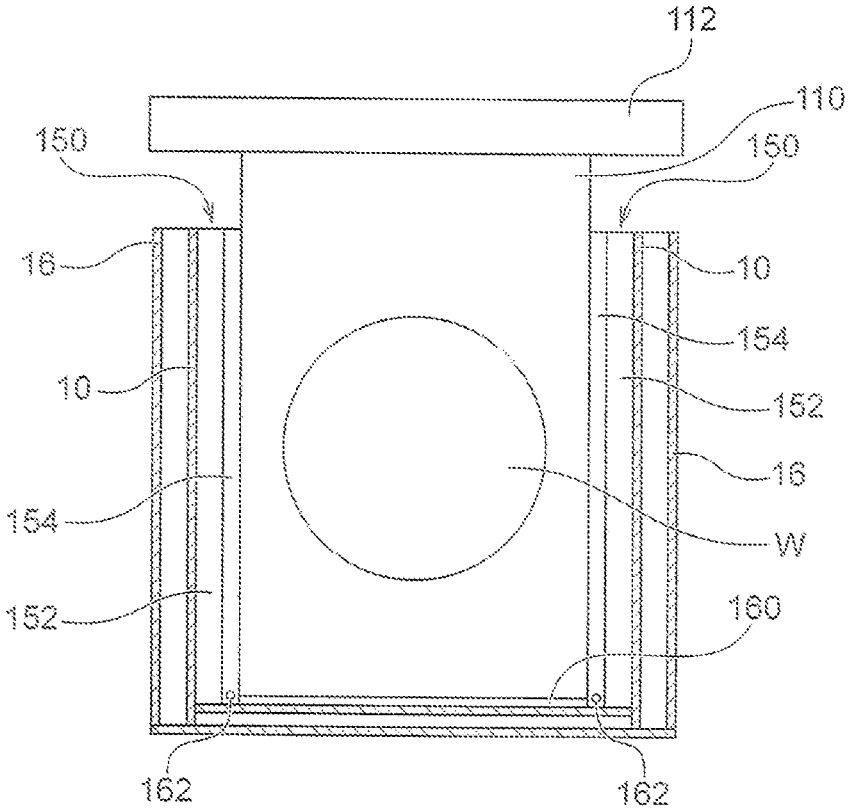
FIG. 6C is a drawing when viewed in the direction indicated by an arrow 6C in FIG. 6A.

FIG. 6A is a drawing illustrating the plating tank 10 in a state where the substrate holder 11 is disposed in one embodiment. As illustrated in FIG. 6A, the plating tank 10 has the inside side surface on which the block mechanism 150 for preventing the diversion of the electric field inside the plating tank 10 is disposed. FIG. 6B is a drawing illustrating near the block mechanism 150 illustrated in FIG. 6A enlarged. FIG. 6C is a drawing when viewed in the direction indicated by an arrow 6C in FIG. 6A.

In the embodiment illustrated in FIGS. 6A to 6C, the block mechanism 150 includes the guiding member 152 disposed on the inside side surface of the plating tank 10. As illustrated in FIG. 6A and FIG. 6B, the guiding member 152 according to one embodiment can be the two opposed plate-shaped members extending from the opened upper end to the lower end where there is the bottom surface of the plating tank 10 on the side surface of the plating tank 10. As illustrated, the block mechanism 150 includes the seal block 154 supported by the guiding members 152. The seal block 154 according to one embodiment can be the plate-shaped member disposed between the guiding members 152 as illustrated. The seal block 154 is configured to be movable toward the inside of the plating tank 10 in a state of being supported by the guiding members 152. In one embodiment, as illustrated in FIG. 6C, the plating tank 10 includes the bottom seal 160 on the bottom surface. The bottom seal 160 is configured such that the bottom surface of the substrate holder 11 is brought into contact with the bottom seal 160 in a state where the substrate holder 11 is disposed in the plating tank 10. The bottom seal 160 can be the depressed portion or the projecting portion formed on the bottom surface of the plating tank 10 for one example. As illustrated in FIG. 6C, the seal block 154 is supported by hinges 162 or pins from the bottom seal 160. Alternatively, the seal block 154 may be configured to be supported by the hinge 162 at a structure near the bottom surface of the plating tank 10, not by the bottom seal 160. The seal block 154 can rotationally move about the hinge 162 while being supported by the guiding members 152. As illustrated in FIG. 6C, the hinge 162 is disposed near a lower end of the seal block 154, and the seal block 154 can rotationally move in the direction parallel to a planar surface of the substrate W held onto the substrate holder 11. Therefore, when the seal block 154 rotationally moves about the hinge 162, the distance between the substrate holder 11 and the seal block 154 decreases.

In one embodiment, as illustrated in FIG. 6B, the seal block 154 has the end at which the fluid spring 157 is disposed. In the embodiment illustrated in FIGS. 6A to 6C, the fluid spring 157 is disposed near the upper end of the seal block 154 between the two guiding members 152. The fluid spring 157 is connected to the fluid flow passage and the fluid source, which are not illustrated. As soon as a fluid is supplied to the fluid spring 157, the fluid spring 157 expands to rotationally move the seal block 154 toward the side surface of the substrate holder 11 about the hinge 162. As soon as the fluid is discharged from the fluid spring 157, the fluid spring 157 contracts to rotationally move the seal block 154 in the direction pulling away from the side surface of the substrate holder 11 about the hinge 162.

In one embodiment, the fluid spring 157 can be a pneumatic spring. In one embodiment, the seal block 154 may be moved by, for example, a cam mechanism instead of the fluid spring 157.

In one embodiment, as illustrated in FIG. 6B, the seal block 154 includes the seal 156 extending in the height direction on the end surface in the inside direction of the plating tank 10. In one embodiment, the seal 156 can be disposed in the depressed portion formed in the height direction on the end surface in the inside direction of the plating tank 10 of the seal block 154. In the embodiment illustrated in FIGS. 6A to 6C, when the seal block 154 moves in the inside direction of the plating tank 10, the seal 156 is brought into contact with the side surface of the substrate holder 11. Therefore, the gap between the side surface of the substrate holder 11 and the side surface of the plating tank 10 can be eliminated. No gap between the side surface of the substrate holder 11 and the side surface of the plating tank 10 ensures preventing the electric field between one surface of the substrate W and the corresponding anode 31*a* or 31*b* from being diverted around to the opposite side of the substrate W. Note that the seal 156 that contacts the side surface of the substrate holder 11 may be eliminated as one embodiment. As one embodiment, the seal block 154 is not necessarily brought into contact with the side surface of the substrate holder 11. When the distance between the substrate holder 11 and the seal block 154 decreases due to the move of the seal block 154, the diversion of the electric field decreases even without causing the distance between the substrate holder 11 and the seal block 154 to be zero, thereby ensuring forming a uniform plating film.

Figure 7A:
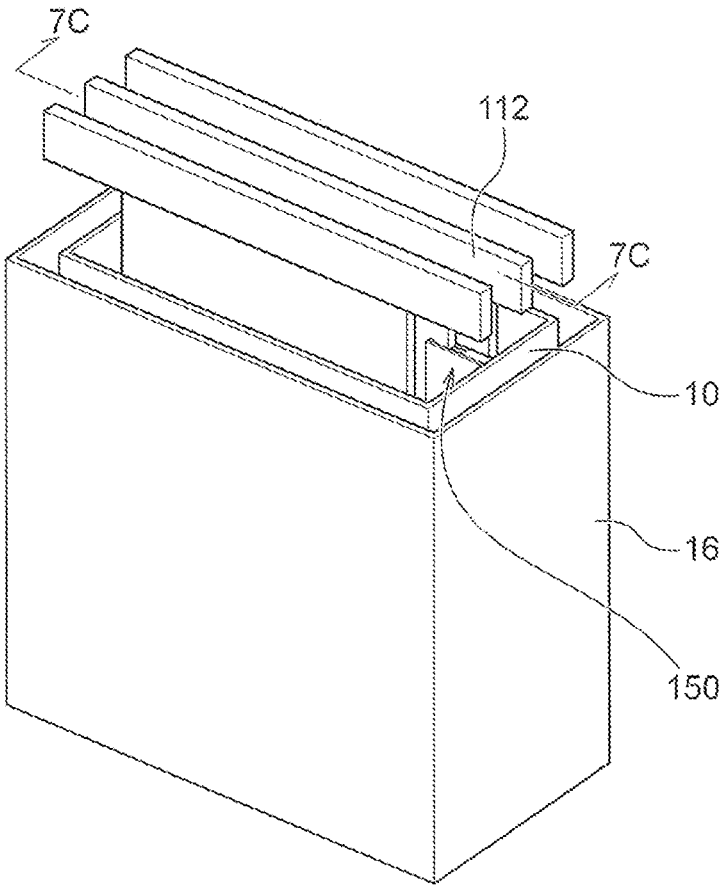
FIG. 7A is a drawing illustrating the plating tank in a state where the substrate holder is disposed according to one embodiment.
Figure 7B:
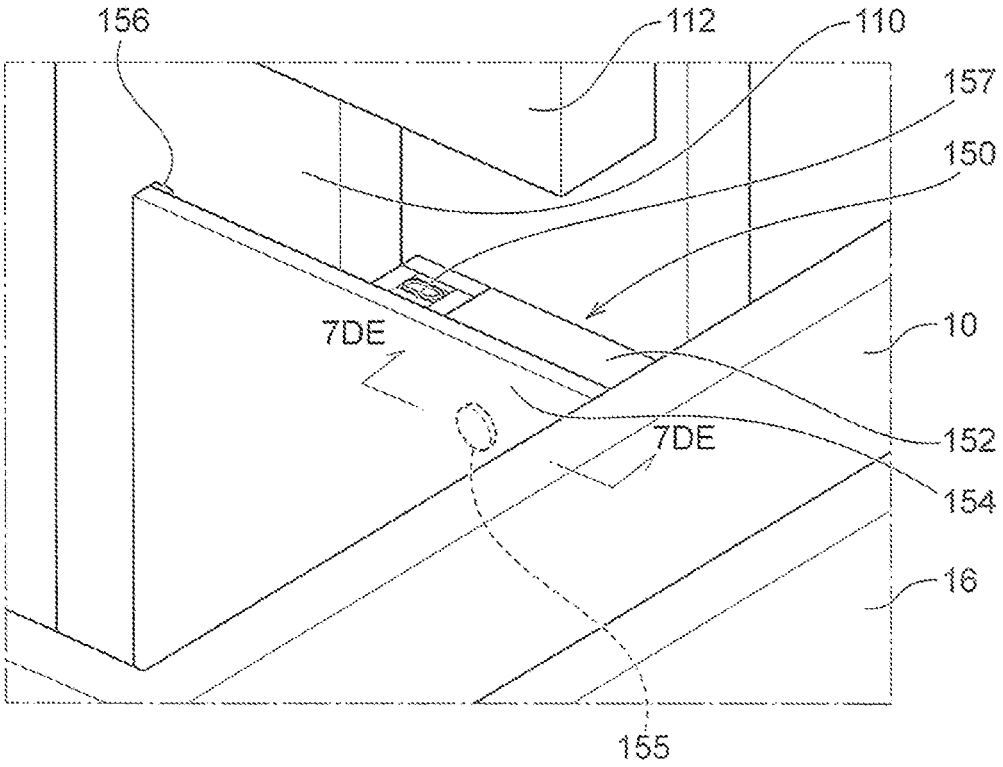
FIG. 7B is a drawing illustrating near a block mechanism illustrated in FIG. 7A enlarged.
Figure 7C:
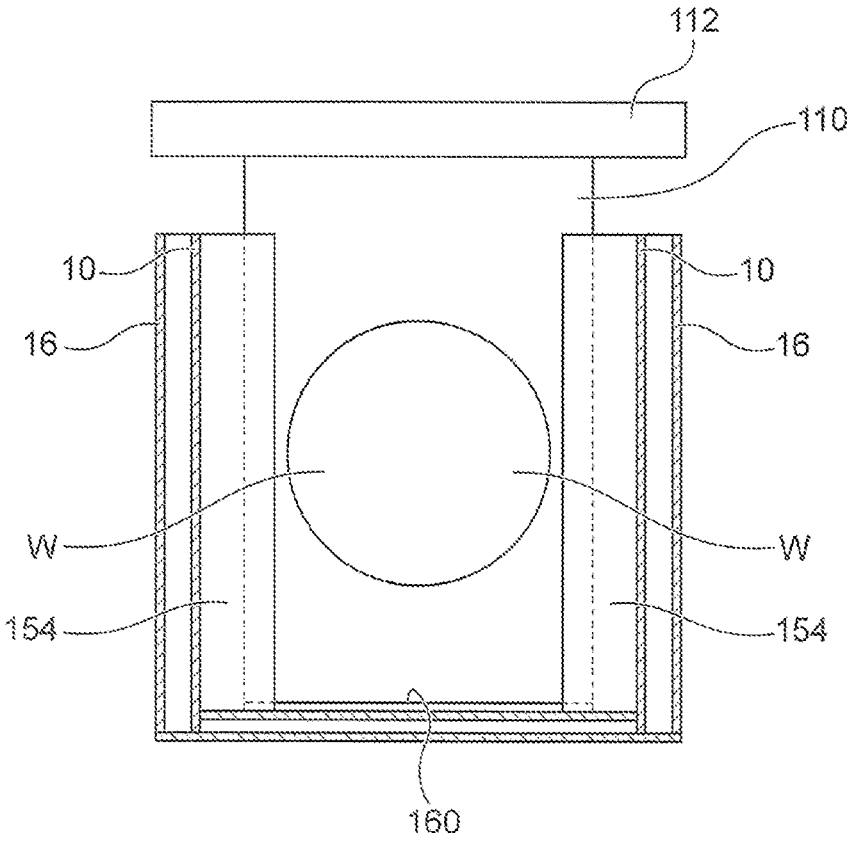
FIG. 7C is a drawing when viewed in the direction indicated by an arrow 7C in FIG. 7A.

FIG. 7A is a drawing illustrating the plating tank 10 in a state where the substrate holder 11 is disposed according to one embodiment. As illustrated in FIG. 7A, the plating tank 10 has the inside side surface on which the block mechanism 150 for preventing the diversion of the electric field inside the plating tank 10 is disposed. FIG. 7B is a drawing illustrating near the block mechanism 150 illustrated in FIG. 7A enlarged. FIG. 7C is a drawing when viewed in the direction indicated by an arrow 7C in FIG. 7A.

In the embodiment illustrated in FIGS. 7A to 7E, the block mechanism 150 includes the guiding member 152 disposed on the inside side surface of the plating tank 10. As illustrated in FIGS. 7A to 7E, the guiding member 152 according to one embodiment can be the plate-shaped member extending from the opened upper end to the lower end where there is the bottom surface of the plating tank 10 on the side surface of the plating tank 10. As illustrated, the block mechanism 150 includes the seal block 154 supported by the guiding member 152. The seal block 154 according to one embodiment can be a plate-shaped member disposed on one surface of the guiding member 152 as illustrated. The seal block 154 is configured to be movable in the direction perpendicular to the surface of the substrate W disposed in the substrate holder 11 inside the plating tank 10 in a state of being supported by the guiding member 152. In one embodiment, as illustrated in FIG. 7C, the plating tank 10 includes the bottom seal 160 on the bottom surface. The bottom seal 160 can be one similar to the bottom seal 160 described with FIGS. 5A to 6C.

In one embodiment, as illustrated in FIG. 7B, the fluid spring 157 is disposed on a surface on a side of the seal block 154 of the guiding member 152. The fluid spring 157 extends over the entire height of the guiding member 152. The fluid spring 157 is disposed in a depressed portion formed on the surface on the seal block 154 side of the guiding member 152 as illustrated in FIG. 7B. The fluid spring 157 is connected to the fluid flow passage and the fluid source, which are not illustrated. As soon as a fluid is supplied to the fluid spring 157, the fluid spring 157 expands to move the seal block 154 in the direction separating from the surface of the substrate holder 11. As soon as the fluid is discharged from the fluid spring 157, the fluid spring 157 contracts to move the seal block 154 toward the surface of the substrate holder 11. Note that "the surface of the substrate holder" is a surface of the substrate holder parallel to the surface to be plated of the substrate held onto the substrate holder. In one embodiment, the fluid spring 157 can be a pneumatic spring. In one embodiment, the seal block 154 may be moved by, for example, a cam mechanism instead of the fluid spring 157. Note that the fluid spring 157 is only necessary to be disposed so as to be able to move the seal block 154 as described above, and it is not necessarily required to extend over the entire height of the seal block 154. For example, the plurality of fluid springs 157 may be disposed in the height direction of the seal block 154 at predetermined intervals.

Figure 7D:
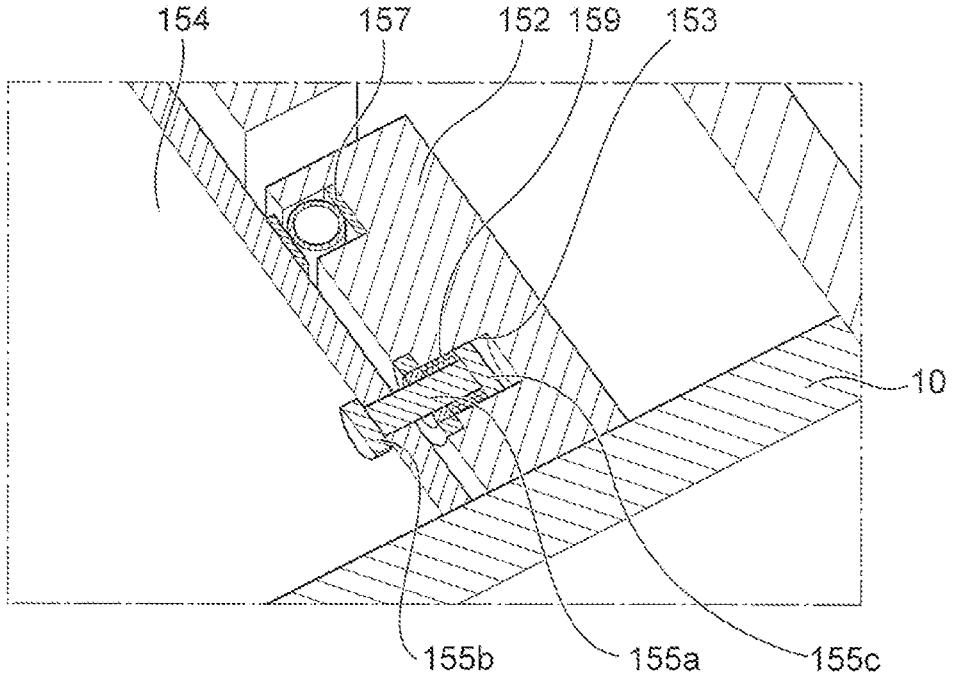
FIG. 7D is a partial cross-sectional view cut along an arrow 7DE in FIG. 7B, and illustrates a state where a fluid spring expands and a seal block is in a position apart from the substrate holder.
Figure 7E:
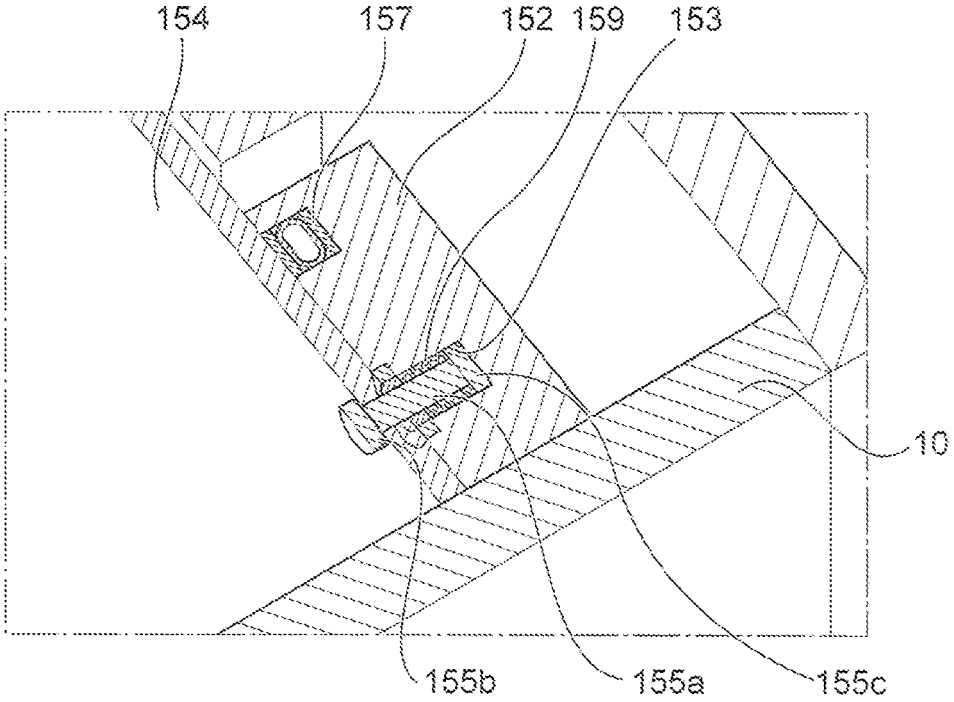
FIG. 7E is a partial cross-sectional view cut along the arrow 7DE in FIG. 7B, and illustrates a state where the fluid spring contracts and the seal block is in a position close to the substrate holder.

In one embodiment, as illustrated in FIG. 7B, the guiding member 152 and the seal block 154 are connected by a connecting pin 155. In the embodiment illustrated in FIGS. 7A to 7E, a plurality of the connecting pins 155 are disposed in the height direction of the guiding member 152. FIG. 7D and FIG. 7E are partial cross-sectional views cut along an arrow 7DE in FIG. 7B. As illustrated in FIGS. 7D and 7E, the connecting pin 155 has a shaft 155*a* and heads 155*b* and 155*c* positioned on both ends of the shaft 155*a*. The shaft 155*a* is a member in a columnar shape. The heads 155*b* and 155*c* are members in a circular-plate shape or a columnar shape having a radius larger than that of the shaft 155*a*. As illustrated in FIGS. 7D and 7E, one head 155*b* is disposed on a surface on the opposite side of the substrate holder 11 of the seal block 154, and the shaft 155*a* extends to a depressed portion 153 formed in the guiding member 152 passing through the seal block 154. The head 155*c* on the opposite side is disposed in the depressed portion 153 formed in the guiding member 152. As illustrated in FIGS. 7D and 7E, a spring 159, for example, a coil spring, is disposed so as to surround the shaft 155*a* within the depressed portion 153 of the guiding member 152. The spring 159 is disposed so as to bias the connecting pin 155 in the direction to draw inside the depressed portion 153.

As soon as a fluid is supplied to the fluid spring 157, the fluid spring 157 expands to move the seal block 154 in the direction separating from the substrate holder 11 by overcoming the biasing force of the spring 159. Meanwhile, as soon as the fluid is discharged from the fluid spring 157, the fluid spring 157 contracts to move the seal block 154 toward the side surface of the substrate holder 11 by the biasing force of the spring 159. FIG. 7D illustrates a state where the fluid spring 157 expands and the seal block 154 is in a position apart from the substrate holder 11. FIG. 7E illustrates a state where the fluid spring 157 contracts and the seal block 154 is in a position close to the substrate holder 11. Note that, in one embodiment, the seal block 154 may be configured to be brought close to the direction of the substrate holder 11 when the fluid spring 157 expands by disposing the guiding member 152, the fluid spring 157, the connecting pin 155, and the spring 159 described above on a surface on the opposite side of the seal block 154. In the embodiment illustrated in FIGS. 7A to 7E, the seal block 154 may be configured to move as described above by the expansion and the contraction of the fluid spring 157 without using the connecting pin 155 or the spring 159. Furthermore, in the embodiment illustrated in FIGS. 7A to 7E, in addition to effects of the expansion and the contraction of the fluid spring 157, the seal block 154 may be configured to be moved as described above by effects of the connecting pin 155 and the spring 159. A configuration similar to that of the above-described connecting pin 155 and spring 159 may be applied to the embodiments in FIGS. 5A to 6C.

In one embodiment, as illustrated in FIG. 7B, the seal block 154 includes the seal 156 that faces the direction of the substrate holder 11 at an end in the inside direction of the plating tank 10. The seal 156 extends in the height direction from the upper end to the lower end of the seal block 154. In one embodiment, the seal 156 can be disposed in a depressed portion formed in the height direction of the seal block 154. In the embodiment illustrated in FIGS. 7A to 7E, the seal 156 is brought into contact with the surface near the end of the substrate holder 11 when the seal block 154 moves in the direction of the substrate holder 11. Therefore, the gap between the surface of the substrate holder 11 and the side surface of the plating tank 10 can be eliminated. No gap between the surface near the end of the substrate holder 11 and the side surface of the plating tank 10 ensures preventing the electric field between one surface of the substrate W and the corresponding anode 31*a* or 31*b* from being diverted around to the opposite side of the substrate W. Note that, as one embodiment, the seal 156 that is brought into contact with the surface of the substrate holder 11 may be eliminated. As one embodiment, the seal block 154 is not necessarily in contact with the surface of the substrate holder 11. When the distance between the substrate holder 11 and the seal block 154 decreases due to the move of the seal block 154, the diversion of the electric field decreases even without causing the distance between the substrate holder 11 and the seal block 154 to be zero, thereby ensuring forming a uniform plating film.

Figure 8:
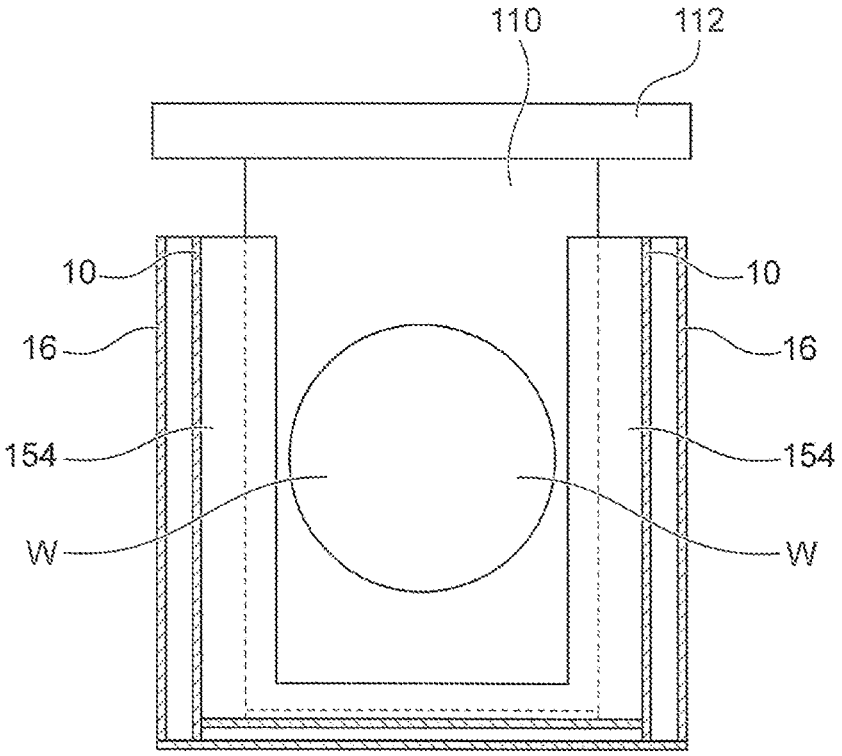
FIG. 8 is a drawing illustrating the plating tank in a state where the substrate holder is disposed according to one embodiment.

FIG. 8 is a drawing illustrating the plating tank 10 in a state where the substrate holder 11 is disposed according to one embodiment. FIG. 8 is a drawing when viewed in the direction similar to those of FIG. 6C and FIG. 7C. In the embodiment illustrated in FIG. 8, the seal block 154 is supported by the guiding member 152 similarly to the embodiment illustrated in FIGS. 7A to 7E. However, in the embodiment illustrated in FIG. 8, the seal block 154 is a plate-shaped member in an approximately U shape and extends along both the side portions and the bottom portion of the plating tank 10. In the embodiment illustrated in FIG. 8, the seal block 154 includes the seal 156 facing the direction of the substrate holder 11. The seal 156 is disposed along the U-shaped seal block 154. In the embodiment illustrated in FIG. 8, other than the shape of the seal block 154, the configuration can be similar to that of the embodiment in FIGS. 7A to 7E. In the embodiment illustrated in FIG. 8, when the seal block 154 moves in the direction of the substrate holder 11, the seal 156 is brought into contact with the surface near the side surface end of the substrate holder 11 and the surface near the bottom portion. Therefore, the gap between the surface of the substrate holder 11 and the side surface and bottom surface of the plating tank 10 can be eliminated. No gap between the surface near the end and the surface near the bottom portion of the substrate holder 11 and the side surface and bottom surface of the plating tank 10 ensures preventing the electric field between one surface of the substrate W and the corresponding anode 31*a* or 31*b* from being diverted around to the opposite side of the substrate W. Note that, as one embodiment, the seal 156 that is brought into contact with the surface of the substrate holder 11 may be eliminated. As one embodiment, the seal block 154 is not necessarily in contact with the surface of the substrate holder 11. When the distance between the substrate holder 11 and the seal block 154 decreases due to the move of the seal block 154, the diversion of the electric field decreases even without causing the distance between the substrate holder 11 and the seal block 154 to be zero, thereby ensuring forming a uniform plating film.

Figure 9A:
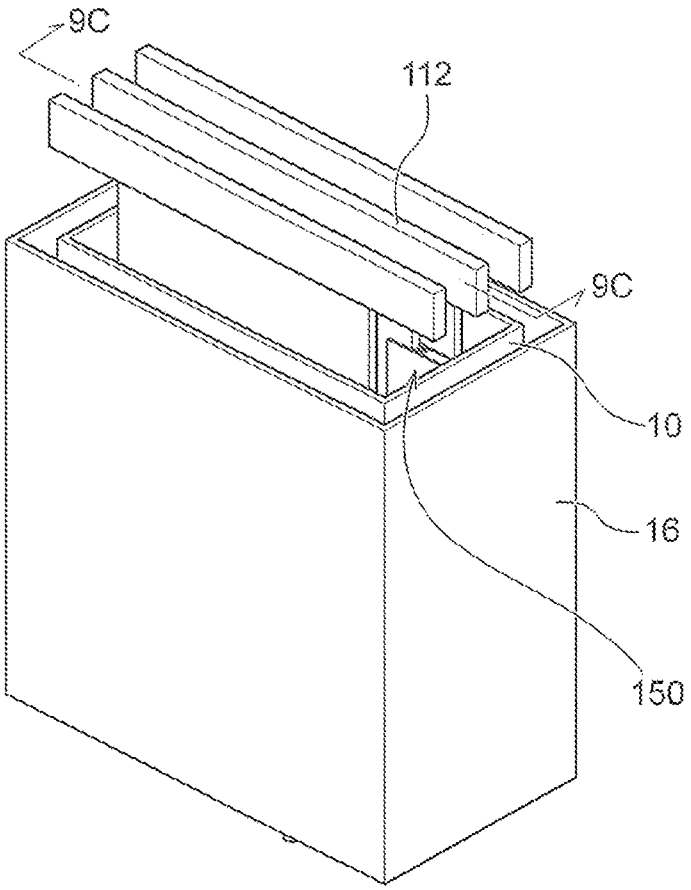
FIG. 9A is a drawing illustrating the plating tank in a state where the substrate holder is disposed according to one embodiment.
Figure 9B:
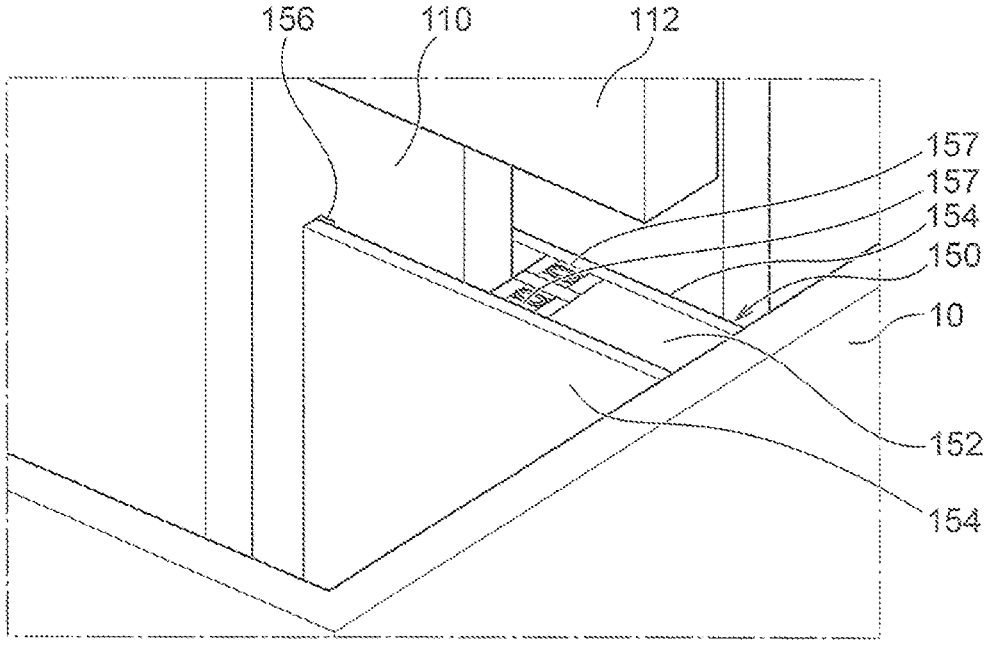
FIG. 9B is a drawing illustrating near a block mechanism illustrated in FIG. 9A enlarged.
Figure 9C:
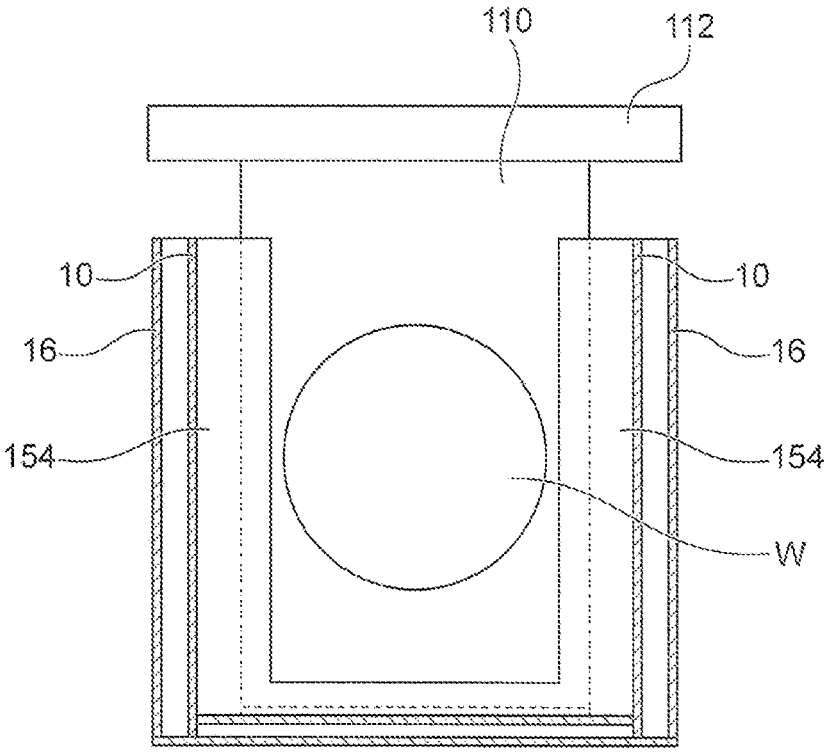
FIG. 9C is a drawing when viewed in the direction indicated by an arrow 9C in FIG. 9A.

FIG. 9A is a drawing illustrating the plating tank 10 in a state where the substrate holder 11 is disposed according to one embodiment. As illustrated in FIG. 9A, the plating tank 10 has the inside side surface on which the block mechanism 150 for preventing the diversion of the electric field inside the plating tank 10 is disposed. FIG. 9B is a drawing illustrating near the block mechanism 150 illustrated in FIG. 9A enlarged. FIG. 9C is a drawing when viewed in the direction indicated by an arrow 9C in FIG. 9A.

In the embodiment illustrated in FIGS. 9A to 9C, the block mechanism 150 includes the guiding member 152 disposed on the inside side surface of the plating tank 10. As illustrated in FIGS. 9A to 9C, the guiding member 152 in one embodiment can be a plate-shaped member extending from the opened upper end to the lower end where there is the bottom surface of the plating tank 10 on the side surface of the plating tank 10. As illustrated, the block mechanism 150 includes the seal blocks 154 supported by the guiding member 152. In the embodiment illustrated in FIGS. 9A to 9C, the seal block 154 illustrated in FIG. 8 is disposed on both the surfaces of the guiding member 152. Each of the seal blocks 154 is configured to be movable in the direction perpendicular to the surface of the substrate W disposed in the substrate holder 11 inside the plating tank 10 in a state of being supported by the guiding member 152. A moving mechanism of the seal block 154 can be, for example, the fluid spring 157 and the cam mechanism as described above. Although it is not illustrated in FIGS. 9A to 9C, the embodiment illustrated in FIGS. 9A to 9C may include the connecting pin 155 and the spring 159 described with FIGS. 7A to 7E.

In the embodiment illustrated in FIGS. 9A to 9C, the seal block 154 is the plate-shaped member in an approximately U shape, and extends along both the side portions and the bottom portion of the plating tank 10. As illustrated in FIG. 9B, the seal block 154 includes the seal 156 that faces the direction of the substrate holder 11. The seal 156 is disposed along the U-shaped seal block 154. In the embodiment illustrated in FIGS. 9A to 9C, when the seal block 154 moves in the direction of the substrate holder 11, the seal 156 is brought into contact with the surface near the side surface end and the surface near the bottom portion of the substrate holder 11. Therefore, the gap between the surface of the substrate holder 11 and the side surface and bottom surface of the plating tank 10 can be eliminated. No gap between the surface near the end and the surface near the bottom portion of the substrate holder 11 and the side surface and bottom surface of the plating tank 10 ensures preventing the electric field between one surface of the substrate W and the corresponding anode 31*a* or 31*b* from being diverted around to the opposite side of the substrate W. In the embodiment in FIGS. 9A to 9C, the seal blocks 154 are disposed on both the surfaces of the substrate holder 11. Therefore, the diversion of the electric field can be further prevented. Since the seal blocks 154 are disposed on both the sides with respect to the substrate holder 11, symmetry of the electric field and a flow of a liquid increases when the plating process is performed, thereby being advantageous. Note that, as one embodiment, the seal 156 that is brought into contact with the surface of the substrate holder 11 may be eliminated. As one embodiment, the seal block 154 is not necessarily in contact with the surface of the substrate holder 11. When the distance between the substrate holder 11 and the seal block 154 decreases due to the move of the seal block 154, the diversion of the electric field decreases even without causing the distance between the substrate holder 11 and the seal block 154 to be zero, thereby ensuring forming a uniform plating film. Note that, while in the embodiment illustrated in FIGS. 9A to 9C, the seal block 154 is the approximately U-shaped member, for example, the plate-shaped seal blocks 154 described with FIGS. 7A to 7E may be disposed on both the sides of the substrate holder 11 as another embodiment. In this case, the plating tank 10 may include the bottom seal 160.

The features of the plating tank according to this disclosure are applicable to the plating tank for a quadrilateral substrate, not only for the substrate W in a circular shape. In the case of plating the quadrilateral substrate, roughly, there are a case where power is fed to four sides of the substrate and a case where power is fed to two sides. For example, in the case of feeding power to the two sides, there sometimes is a case where an influence of the diversion of the electric field on uniformity of the plating is not so large regarding the proximity of sides without the power feeding. As the embodiment in this disclosure, the seal block 154 may be disposed on a whole region where the plating solution exists around the substrate W, or the seal block 154 may be disposed locally on a region largely affected by the diversion of the electric field.

The embodiments of the present invention have been described above based on some examples in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited.

From the above-described embodiments, at least the following technical ideas are obtained.

[Configuration 1] According to a configuration 1, it is a plating apparatus for performing a plating process on a substrate held onto a substrate holder. The plating apparatus includes a plating tank configured to receive the substrate holder holding the substrate, a block member that extends to an inside of the plating tank from a wall surface of the inside of the plating tank, and is movable inside the plating tank, and a moving mechanism for moving the block member toward the substrate holder disposed inside the plating tank.

[Configuration 2] According to a configuration 2, in the plating apparatus according to the configuration 1, the moving mechanism is configured to move the block member toward a side surface of the substrate holder disposed inside the plating tank.

[Configuration 3] According to a configuration 3, in the plating apparatus according to the configuration 1, the moving mechanism is configured to move the block member toward a front surface of the substrate holder disposed inside the plating tank.

[Configuration 4] According to a configuration 4, in the plating apparatus according to the configuration 1, the moving mechanism is configured to move the block member toward a back surface of the substrate holder disposed inside the plating tank.

[Configuration 5] According to a configuration 5, in the plating apparatus according to any one of the configuration 1 to the configuration 4, the block member includes a sealing member contactable to the substrate holder disposed inside the plating tank.

[Configuration 6] According to a configuration 6, in the plating apparatus according to any one of the configuration 1 to the configuration 5, the block member extends in a height direction of the plating tank.

[Configuration 7] According to a configuration 7, in the plating apparatus according to any one of the configuration 1 to the configuration 5, the block member extends along a side surface and a bottom surface inside the plating tank.

[Configuration 8] According to a configuration 8, in the plating apparatus according to any one of the configuration 1 to the configuration 7, the moving mechanism includes a fluid spring.

[Configuration 9] According to a configuration 9, in the plating apparatus according to any one of the configuration 1 to the configuration 7, the moving mechanism includes a cam element.

REFERENCE SIGNS LIST

10 . . . plating tank
11 . . . substrate holder
16 . . . outer tank
110 . . . main body
112 . . . arm
114 . . . power feeding contact
116 . . . electrical contact
118 . . . inner seal ring
120 . . . outer seal ring
150 . . . block mechanism
152 . . . guiding member
153 . . . depressed portion
154 . . . seal block
155 . . . connecting pin
156 . . . seal
157 . . . fluid spring
159 . . . spring
160 . . . bottom seal
162 . . . hinge
W . . . substrate

What is claimed is:

1. A plating apparatus for performing a plating process on a substrate held onto a substrate holder, the plating apparatus comprising:

a plating tank configured to receive the substrate holder holding the substrate; and a block mechanism for reducing a diversion of an electric field into a region between a side surface of the substrate holder and an inner surface of the plating tank, the block mechanism comprising:

a guiding member fixed on the inner surface of the plating tank and extending to an inside of the plating tank from the inner surface of the plating tank;

a seal block supported by the guiding member; and a moving mechanism configured to move the seal block toward the substrate holder disposed inside the plating tank.

2. The plating apparatus according to claim 1, wherein the moving mechanism is configured to move the seal block toward a side surface of the substrate holder disposed inside the plating tank.

3. The plating apparatus according to claim 1, wherein the moving mechanism is configured to move the seal block toward a front surface of the substrate holder disposed inside the plating tank.

4. The plating apparatus according to claim 1, wherein the moving mechanism is configured to move the seal block toward a back surface of the substrate holder disposed inside the plating tank.

5. The plating apparatus according to claim 1, wherein the seal block includes a sealing member contactable to the substrate holder disposed inside the plating tank.

6. The plating apparatus according to claim 1, wherein the seal block extends in a height direction of the plating tank.

7. The plating apparatus according to claim 1, wherein the seal block extends along a side surface and a bottom surface inside the plating tank.

8. The plating apparatus according to claim 1, wherein the moving mechanism includes a fluid spring.

9. The plating apparatus according to claim 1, wherein the moving mechanism includes a cam element.

10. The plating apparatus according to claim 1, wherein the guiding member comprises: a pair of guiding member, each of which is disposed at opposing side inner surface of the plating tank.

11. The plating apparatus according to claim 1, wherein the guiding member comprises two opposed plate-shaped members, and the seal block is disposed between the two opposed plate-shaped members.

* * * * *